US009914238B2

(12) United States Patent
David et al.

(10) Patent No.: US 9,914,238 B2
(45) Date of Patent: Mar. 13, 2018

(54) APPARATUS FOR GENERATING A PULSATING PRESSURIZED FLUID JET

(71) Applicant: Ecoclean GmbH, Filderstadt (DE)

(72) Inventors: Hermann-Josef David, Monschau (DE); Egon Kaske, Aachen (DE); Norbert Klinkhammer, Roetgen (DE)

(73) Assignee: ECOCLEAN Gmbh, Filderstadt (DE)

( * ) Notice: Subject to any disclaimer, the term of this patent is extended or adjusted under 35 U.S.C. 154(b) by 327 days.

(21) Appl. No.: 14/177,871

(22) Filed: Feb. 11, 2014

(65) Prior Publication Data

US 2014/0165807 A1 Jun. 19, 2014

Related U.S. Application Data

(63) Continuation-in-part of application No. PCT/EP2012/060208, filed on May 31, 2012.

(30) Foreign Application Priority Data

Aug. 11, 2011 (DE) ..... 10 2011 080 852

(51) Int. Cl.
*B26F 3/00* (2006.01)
*B05B 13/06* (2006.01)
(Continued)

(52) U.S. Cl.
CPC ..... *B26F 3/004* (2013.01); *B05B 13/0636* (2013.01); *B05B 17/0607* (2013.01);
(Continued)

(58) Field of Classification Search
CPC ..... B26F 3/004; B24C 7/0061; B24C 1/086; B24C 5/005; B05B 17/0607; B05B 13/0636; Y10T 83/364
See application file for complete search history.

(56) References Cited

U.S. PATENT DOCUMENTS 2,508,874 A * 5/1950 Turnbull ..... B24C 5/04 164/137
5,154,347 A 10/1992 Vijay
(Continued)

FOREIGN PATENT DOCUMENTS

DE 102011080852 2/2013
EP 0062111 10/1982
(Continued)

OTHER PUBLICATIONS

Microspray, How Ultrasonic Spray Nozzles Work, Apr. 2, 2014, YouTube, available on Oct. 13, 2016, at : https://www.youtube.com/watch?v=VtMyEVbr620.*
(Continued)

*Primary Examiner* — Jonathan Riley
(74) *Attorney, Agent, or Firm* — Hanley, Flight & Zimmerman, LLC

(57) ABSTRACT

Apparatus for generating a pulsating pressurized fluid jet are disclosed. One disclosed example includes a line system having at least one nozzle with at least one nozzle orifice from which a pulsating fluid jet of pressurized fluid emerges, and a chamber having a pressure wave generating device to generate fluid pressure waves, where the chamber is in fluid communication with the line system through an outlet opening for the generated fluid pressure waves. The disclosed example also includes a setting device for controlling the amplitude of the fluid pressure waves in the line system upstream of the at least one nozzle orifice where the setting device sets a quotient of a path length of the fluid pressure waves between the outlet opening and the at least one nozzle orifice, and the wavelength of the fluid pressure waves in the line system.

19 Claims, 9 Drawing Sheets

(51) Int. Cl.

| | |
|---|---|
| ***B05B 17/06*** | (2006.01) |
| ***B24C 1/08*** | (2006.01) |
| ***B24C 5/00*** | (2006.01) |
| ***B24C 7/00*** | (2006.01) |

(52) U.S. Cl.

CPC ..... *B24C 1/086* (2013.01); *B24C 5/005* (2013.01); *B24C 7/0061* (2013.01); *Y10T 83/364* (2015.04)

(56) References Cited

U.S. PATENT DOCUMENTS

| | | | | |
|---|---|---|---|---|
| 6,280,302 | B1 * | 8/2001 | Hashish | B24C 5/04 451/102 |
| 7,740,188 | B2 * | 6/2010 | Foldyna | B05B 17/063 239/102.2 |
| 2004/0089450 | A1 * | 5/2004 | Slade | B24C 1/045 166/298 |
| 2008/0225115 | A1 * | 9/2008 | Matsushita | G01B 11/25 348/129 |
| 2012/0322347 | A1 * | 12/2012 | Molz | B05B 3/02 451/40 |

FOREIGN PATENT DOCUMENTS

| | | | | |
|---|---|---|---|---|
| EP | 2145689 | | 1/2010 | |
| EP | 2145689 | A1 * | 1/2010 | B05B 1/083 |
| GB | 2472998 | | 3/2011 | |
| WO | 2006097887 | | 9/2006 | |
| WO | 2013020732 | | 2/2013 | |

OTHER PUBLICATIONS

Patent Cooperation Treaty, "Written Opinion of the International Searching Authority," issued by the International Searching Authority in connection with PCT application No. PCT/EP2012/060208, dated Feb. 20, 2012, 7 pages.

Patent Cooperation Treaty, "International Search Report," issued by the International Searching Authority in connection with PCT application No. PCT/EP2012/060208, dated Sep. 14, 2012, 5 pages.

German Patent Office, Rough English machine translation of "Search Report," issued in connection with German Patent Application No. 20 2011 104 249.2, dated Apr. 16, 2012, 10 pages.

Patent Cooperation Treaty, "Written Opinion of the International Searching Authority," issued in connection with PCT Application No. PCT/EP2012/060208, dated Sep. 14, 2012, 5 pages.

* cited by examiner

APPARATUS FOR GENERATING A PULSATING PRESSURIZED FLUID JET

RELATED APPLICATION

This patent arises from a continuation-in-part of International Patent Application No. PCT/EP2012/060208, which was filed on May 31, 2012, which claims priority to German Patent Application No. 10 2011 080 852, which was filed on Aug. 11, 2011. The foregoing International Patent Application and German Patent Application are hereby incorporated herein by reference in their entireties.

FIELD OF THE DISCLOSURE

This disclosure relates generally to pulsating pressurized fluid jets, and, more particularly, to pulsating pressurized fluid jets having adjustable pressure waves.

BACKGROUND

Conventionally, to machine workpieces efficiently using fluid jets (e.g., water jets), fluid jets at relatively high pressures (e.g., greater than 3000 bar) have to be generated, which typically requires a great amount of energy. Alternatively, machining of workpieces with corundum and/or sand may cause unwanted residues on the workpieces. In other examples, cutting machining with cutting tools may be disadvantageous in examples where the materials to be cut have high hardness values. Such cutting processes are relatively expensive due to excessive wear of cutting edges of the cutting tools.

Figure 1:
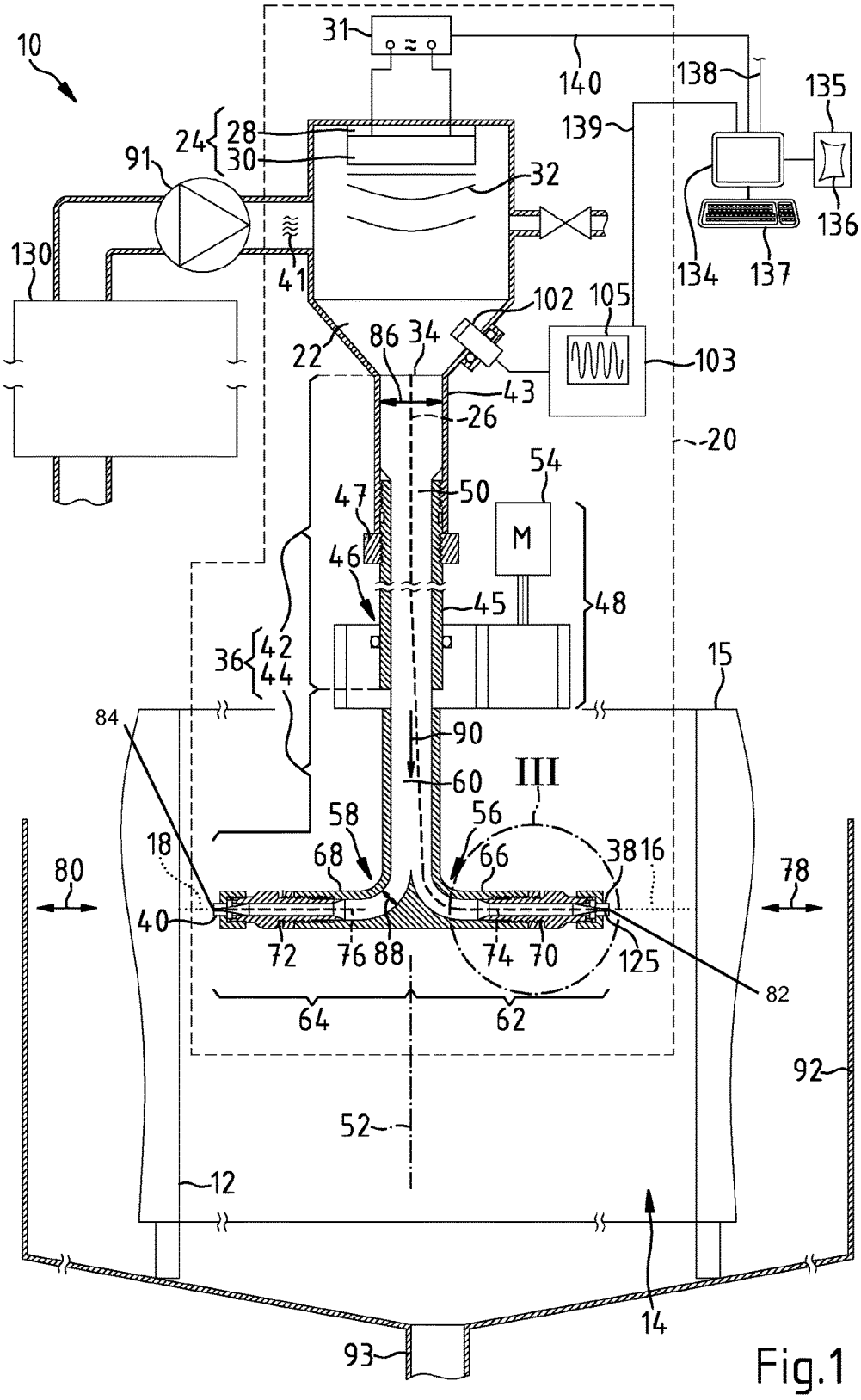
FIG. 1 shows a cross-sectional view of a system having an example apparatus in accordance with the teachings of this disclosure to generate a pulsating fluid jet.

The figures are not to scale. Instead, to clarify multiple layers and regions, the thicknesses of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

The examples disclosed herein provide efficient machining of workpiece surfaces using fluid jets operating in relatively low fluid pressures. Particularly, the examples disclosed herein provide an apparatus in which the surface of workpieces may be activated (e.g., prepared) for coating and/or enables machine coatings to be applied to the workpieces (e.g., to allow removal of overspray and/or layers on workpieces). In accordance with the teachings of this disclosure, some examples include a setting device to adjust the amplitude of the fluid pressure waves in a line system upstream of at least one nozzle orifice. The setting device may be used to set the Helmholtz number, He, where $He=L/\lambda$ (i.e., the quotient of the path length, L, for the fluid pressure waves in the line system between an outlet opening in a chamber and the at least one nozzle orifice of at least one nozzle, and the wavelength, $\lambda$, of the fluid pressure waves in the line system).

The examples disclosed herein are suitable for subjecting a workpiece surface to fluid in the form of, for example, alkaline washing solution, water, and/or emulsion (e.g., water-oil emulsion and/or oil).

A known apparatus for generating a pulsating fluid jet of pressurized fluid is described in WO 2006/097887 A1. There, an apparatus for generating a pulsating fluid jet of pressurized fluid comprising a line system having at least one nozzle with a nozzle orifice from which a fluid jet of pressurized fluid may emerge, and a chamber, in which a pressure wave generating device for generating fluid pressure waves is positioned. The chamber communicates with the line system through an outlet opening for generated fluid pressure waves.

FIG. 1 shows a cross-sectional view of a system 10 having an example apparatus 20 to generate a pulsating fluid jet in accordance with the teachings of this disclosure. The system 10 of the illustrated example shown in FIG. 1 activates a surface 12 of a cylindrical recess 14 in a workpiece 15 by directing pulsating fluid jets 16, 18 of water towards the workpiece 15. To generate the fluid jets 16, 18, the system 10 of the illustrated example has the apparatus 20 with a chamber 22 containing a device 24 to generate fluid pressure waves 32. The device 24 of the illustrated example is communicatively coupled to a controllable (e.g., adjustable) frequency generator 31. In this example, the device 24 comprises a piezo crystal 28, which acts as an electromechanical transducer and is coupled to a sonotrode 30. If the chamber 22 is filled or partially filled with water, the sonotrode 30, in some examples, generates pressure waves 32 in the water, with a frequency, v, preferably in the range of $10\ kHz \leq v \leq 50\ kHz$.

To generate pressure waves, a high-frequency alternating voltage from a frequency generator 31 of the illustrated example is applied to the piezo crystal 28. In the illustrated example, the frequency generator 31 generates ultrasonic frequencies, preferably ultrasonic frequencies in the range of 10 kHz≤v≤50 kHz. By setting the frequency, v, and the amplitude, $A_P$, of the alternating voltage generated by the frequency generator 31, the wavelength, λ, of the pressure waves 32 in the line system 36 may be varied (e.g., adjusted, altered, controlled, etc.).

The chamber 22, in some examples, is preferably tailored to a wavelength range of the fluid pressure waves 32 generated by the sonotrode 30, for example. For fluid pressure waves 32 in this wavelength range, the chamber 22 may act as a resonance chamber.

The chamber 22 of the illustrated example has an outlet opening 34 leading to a line system 36, which fluidly couples the chamber 22 to nozzles 38, 40. The line system 36, in this illustrated example, has a chamber-side portion 42 and comprises a nozzle-side portion 44. The chamber-side portion 42 and the nozzle-side portion 44 of the illustrated example are coupled by a rotary joint 46. In the rotary joint 46, the nozzle-side portion 44 of the illustrated example is moved by a rotary drive motor 48 in an oscillating manner and/or rotated about an axis 52 coaxial to the fluid duct 50 by a drive motor 54.

The nozzles 38, 40 of the illustrated example are located in the nozzle-side portion 44 of the line system 36 within line branches 56, 58, which are separate from one another. The fluid duct 60 in the nozzle-side portion 44 is branched out into the line branches 56, 58.

In the illustrated example, a line portion has lines 62, 64 of adjustable length present in the line branches 56, 58, respectively. The adjustable lines 62, 64 comprise first line sections 66, 68 and second line sections 70, 72 which are at least partially accommodated in the first line section 66, 68 and communicate therewith. The second line sections 70, 72 of the illustrated example may be displaced coaxially relative to the first line sections 66, 68 in the longitudinal directions 74, 76, in a general direction depicted by double-headed arrows 78, 80.

Each of the nozzles 38, 40 of the illustrated example is positioned in respective second line sections 70, 72. The displacement of the second line sections 70, 72 relative to the first line sections 66, 68 allows adjustment of the effective path length 26 of the pressure waves 32 between the outlet opening 34 and the corresponding side of nozzle orifices 82, 84 of the nozzles 38, 40. In the illustrated example, the corresponding side of the nozzle orifices 82, 84 faces away from the workpiece. The movement clearance, in some examples, for the line sections 70, 72 is tailored to the wavelength of the pressure waves 32. The movement clearance of the illustrated example is advantageously at least half a wavelength of the pressure waves 32 and, preferably, in a range between 40 mm and 300 mm. In the portion 42 of the line system 36 of the illustrated example, the line 43 may also be displaced in a translating manner coaxially relative to the line 45 by an adjusting device 47. The adjusting device 47 of the illustrated example allows setting of the effective path length 26 for the pressure waves 32 in the line system 36. Alternatively, the adjusting device 47 may be controlled by a motor drive (e.g., an electric motor drive). The adjustment of the effective path length 26 of the pressure waves 32 in the line system 36 affects the pressure waves 32 to create an oscillation antinode directly upstream of the opening of the nozzle orifice of the nozzles 38, 40 that face away from the workpiece.

The adjusting device 47 of the illustrated example acts as a setting device for adjusting (i.e., setting, controlling, altering, etc.) the amplitude, $A_P$, of the fluid pressure waves 32 in the line system 36 upstream of the at least one nozzle orifice 125. The adjusting device 47 may be used to set a Helmholtz number, He, where He=L/λ. The Helmholtz number is defined as the quotient of the path length, L, of the fluid pressure waves 32 in the line system 36 between the outlet opening 34 in the chamber 22 and the at least one nozzle orifice 125 of the at least one nozzle 38, 40, and the wavelength, λ, of the fluid pressure waves 32 in the line system 36. While the relationship above is used to describe a relationship between path length, L, and the wavelength, λ, any relationship (e.g., mathematical relationship) between any of the aforementioned variables may be used. The adjustable lines 62, 64 of the illustrated example act as a setting device to control (e.g., set, adjust, etc.) the amplitude, $A_P$, of the fluid pressure waves 32 upstream of the corresponding nozzle orifice of the nozzles 38, 40.

In another example, the chamber-side portion and the nozzle-side portion are formed onto a single component. In another example, the nozzle-side portion is mounted such that the nozzle-side portion is displaced in a translating manner on the chamber-side portion without use of a rotary joint in a rotary drive. In such an example, the translating movement of the nozzle-side portion is implemented manually, by spring force, by an electromagnet and/or by an electric linear motor.

The frequency generator 31 of the illustrated example is a settable type. By varying the frequency, v, of the alternating voltage generated by the frequency generator 31, the wavelength, λ, of the pressure waves 32 in the line system 36 and/or the amplitude, $A_P$, of the fluid pressure waves 32 in the line system 36 (e.g., upstream of the nozzle orifice 125) is set (e.g., adjusted, controlled).

In the illustrated example, proceeding from the outlet opening 34 in the chamber 22, effective line cross sections 86, 88 of the lines in the line system 36 decrease monotonically toward the nozzle orifices 82, 84 of the nozzles 38, 40, respectively. Such a decrease in cross-sectional area increases the oscillation amplitude of the pressure of a pressure wave 32 in a general direction depicted by an arrow 90 toward the nozzles 38, 40 in the direction of the fluid stream guided through the line system 36.

In other examples, the apparatus 20 has one nozzle or a multiplicity of nozzles. In yet other examples, the apparatus 20 may have a frequency generator 31 to vary the frequency, v, without a line system comprising of lines of adjustable length.

The system 10 of the illustrated example of FIG. 1 comprises a pressure pump 91 and a container 92 with a funnel-shaped outlet 93 to collect fluid passing from the nozzles 38, 40 onto the workpiece 15. The fluid from the generating pulsating fluid jets in the system 10 is circulated (e.g., circulated in a circuit path) by the pressure pump 91. The pressure pump 91 of the illustrated example may be used to generate and set a fluid pressure in the range from 40 bar to 150 bar and, preferably, on the order of magnitude of 100 bar in the chamber 22. By setting the fluid pressure of the chamber 22, the frequency, v, and the amplitude, $A_P$, of the pressure waves, the size and/or mutual spacing of liquid droplets in fluid jets 16, 18 emerging from the nozzles 38, 40 may be varied (e.g., adjusted, controlled, etc.).

Alternatively, instead of the pressure pump 91, the system 10 may comprise a device having a high-pressure pump to supply fluid at high pressure into the line system 36 of the apparatus 20, which ensures a fluid pressure range that may be up to 3000 bar. In some examples, to subject the fluid in the system to high pressure, a high-pressure pump providing a fluid pressure between 300 bar and 600 bar may be suitable.

Figure 2:
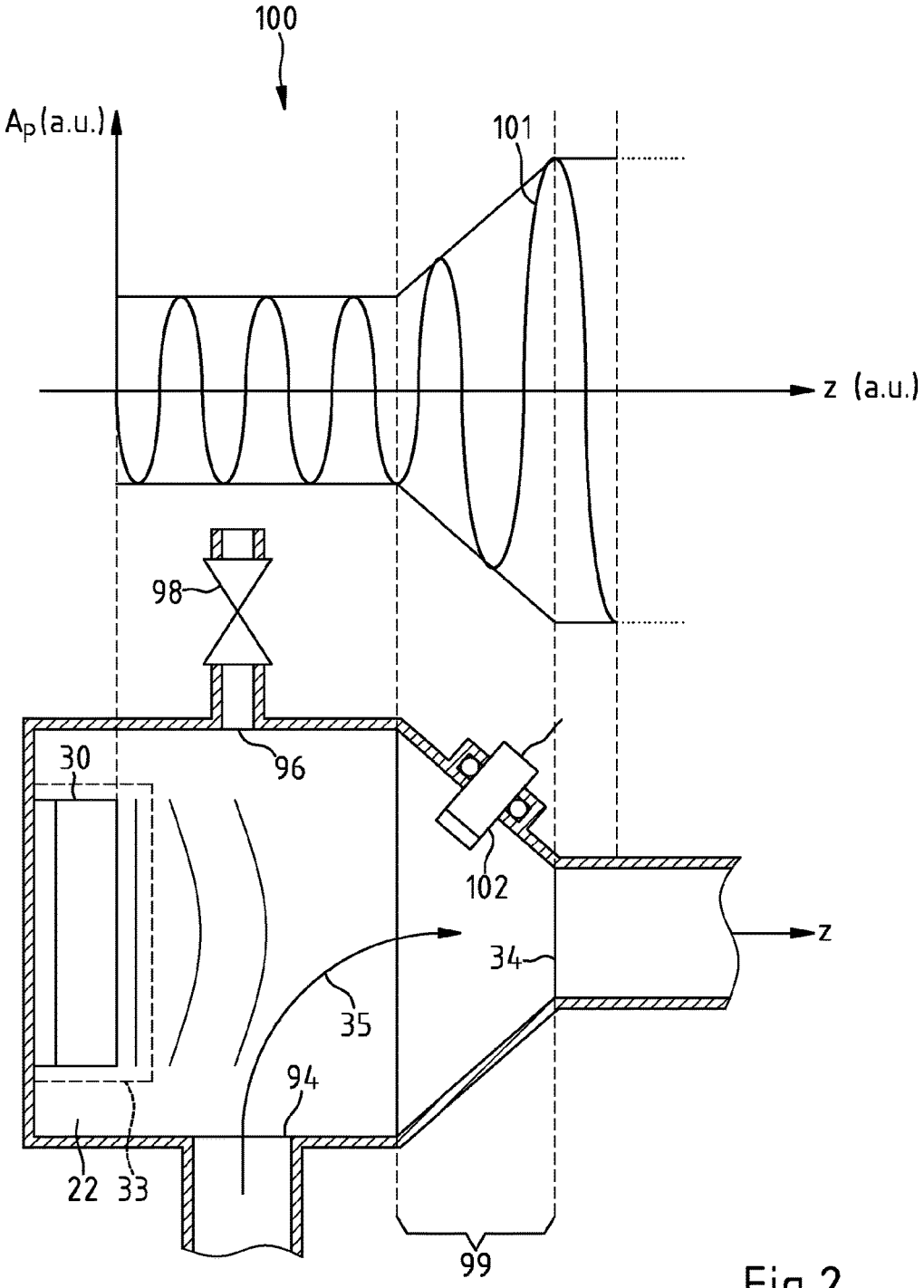
FIG. 2 shows a cross-sectional view of a chamber to generate fluid pressure waves in the example apparatus of FIG. 1.

FIG. 2 shows a cross-sectional view of the chamber 22 to generate the fluid pressure waves 32 in the example apparatus 20 of FIG. 1. The chamber 22 of the illustrated example has an opening 94 to supply pressurized fluid from the high-pressure pump 91. The opening 94 is positioned in a lateral portion of the chamber 22, which, in this example, is separated from the outlet opening 34. The chamber 22 of the illustrated example may be vented through an opening 96 by using a controllable vent valve 98. The sonotrode 30 of the illustrated example is located in the chamber 22 in a dead water region 33, which is spaced from the stream 35 of fluid supplied through the opening 94 and into the chamber 22 moving toward the outlet opening 34.

In a portion 99, the chamber 22 of the illustrated example has a tapered cross section, which is tapered in a funnel-like shape with respect to the outlet opening 34. In the portion 99 of the illustrated example, the amplitude, $A_P$, of the pressure waves 32 generated by the sonotrode 30 of the device 24 are increased. A graph 100 of FIG. 2 depicts, via a curve 101, the amplitude of the pressure of a pressure wave 32 in the chamber 22 corresponding to the distance, z, from the surface 26 of the sonotrode 28 (e.g., the pressure wave amplitude in relationship to the distance shown along the cross-section of FIG. 2).

By setting the pressure, P, and/or the amplitude, $A_P$, of the pressure waves in the chamber 22, the flow rate and/or a form of the pulsating fluid jet generated by the nozzles 38, 40 may be set.

In the illustrated example, a pressure sensor 102 is preferably located in the chamber 22. The pressure sensor 102 of the illustrated example is positioned in the portion 99 of the chamber 22 and communicatively coupled to a measuring device with a display unit. The pressure sensor 102 of the illustrated example is used to sense the pressure fluctuations caused by the pressure waves 32 generated in the portion 99 of the chamber 22. The display unit, in some examples, allows an operator to monitor the operation of the apparatus 20. Additionally or alternatively, for monitoring the operation of the apparatus 20, the system 10 may have a master computer, which may be communicatively coupled to the measuring device and controls the device 24 to generate fluid pressure waves 32 and controls the pressure pump 91 based on the pressure fluctuation signal sensed by the pressure sensor 102.

Additionally or alternatively, in some examples, the operation of the apparatus 20 of the system 10 may be monitored by, for example, supplying the pulsating fluid jet 16, 18 that emerges from the nozzles 38, 40 to an erosion measuring device comprising a test membrane, onto which the fluid jet is directed. If the apparatus 20 is operating correctly (e.g., within specifications or expected values, etc.), an amount of material within a specific range (e.g., a specified range) is removed per unit of time by this test membrane. Conversely, if the test membrane is not removing material within the specific range per unit time, the apparatus 20 is determined to not be operating correctly (e.g., not within specifications or expected values, etc.). In some examples, in order to detect the material removal of such a test membrane, the erosion measuring device comprises a tactile sensor.

Additionally or alternatively, in some examples, a measuring device is installed at a bypass to the drain 93 to detect separated or removed particles (e.g. a magnetic or optical particle counter) for monitoring the operation of the apparatus 20.

In some examples, it is advantageous if the master computer comprises a data storage device, which stores a parameter map for the application-specific setting of the fluid pressure, P, the amplitude, $A_P$, the frequency, v, of the fluid pressure waves 32 generated by the pressure wave generating device, and/or a nozzle rotational speed based on a workpiece-specific application of the apparatus 20 input through an input unit of the computer unit. The parameter map, in some examples, establishes information relating to an empirically determined correlation between the aforementioned operating characteristics and at least one of the following application parameters. Some application parameters include, but are not necessarily limited to, type of the material or substrate to be machined, workpiece geometry, desired/actual workpiece surface quality (e.g., workpiece surface roughness), type of workpiece contamination (e.g. chemical composition or hardness), machining distance between a workpiece to be machined for a specific nozzle diameter and/or the nozzle orifices 82, 84 of the nozzles 38, 40, respectively.

To control the system 10 of the illustrated example, the master computer is communicatively coupled to the pressure pump 91 via a control line and is communicatively coupled to the measuring device 103 and the frequency generator 31 via communication lines 139, 140. The master computer, in some examples, is used to regulate the pressure, which may be generated by the pressure pump in a manner such that wear to the nozzles used in the apparatus 20 is compensated for by, for example, increasing the pump pressure.

Figure 3:
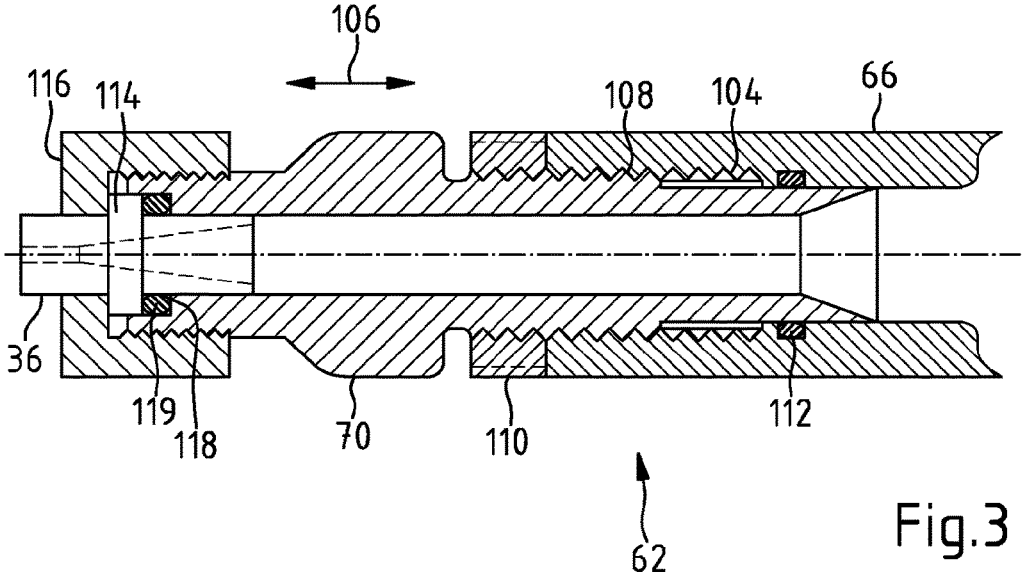
FIG. 3 shows a detailed cross-sectional view of a portion of the example apparatus of FIG. 1 illustrating a line of adjustable length.

FIG. 3 shows a detailed cross-sectional view of the portion III shown in connection with the example apparatus 20 of FIG. 1 illustrating the line 62 of adjustable length. The second line section 70 is threadably engaged to a thread 104 on the first line section 66. The thread 104 of the illustrated example is fine-pitch. In the thread 104, the second line section 70 may be displaced coaxially relative to the first line section 66 in a general direction depicted by a double-headed arrow 106. The second line section 70 may be fixed to the first line section 66 using a locking nut 110 positioned on a thread 108, which may be a fine-pitch thread, of the second line section 70. The second line section 70 sealingly engages the first line section 66 via a sealing ring 112, which, in this example, is positioned in the first line section 66 and substantially prevents fluid from moving between the first line section 66 and the second line section 70.

The nozzle 36 of the illustrated example is accommodated on the second line section 70 and has a flange 114 on the outside, which is pressed by a union nut 116 against a sealing ring 119 positioned on the end face 118 of the second line section 70.

Figure 4:
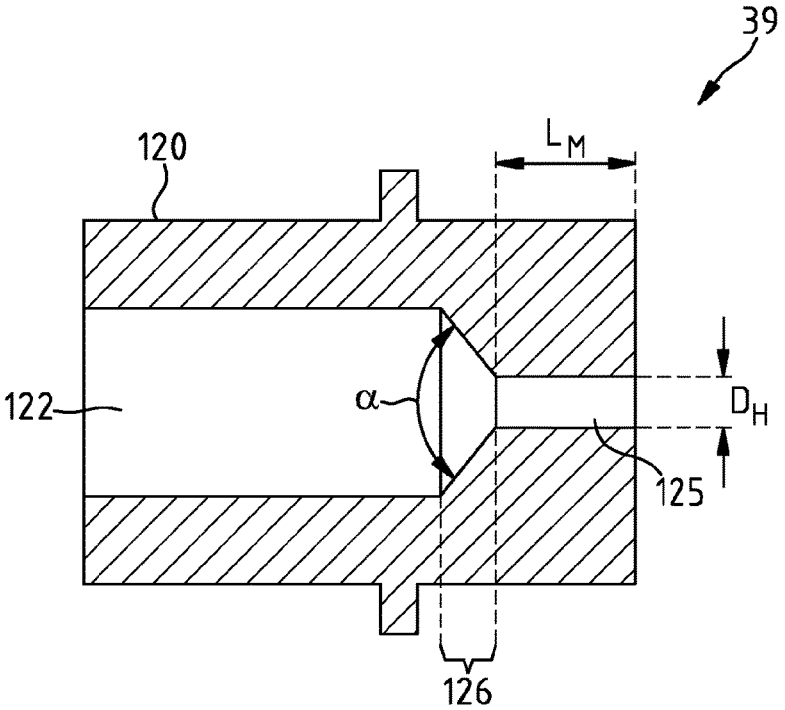
FIG. 4 shows a cross-sectional view of an example nozzle that may be used in the example apparatus of FIG. 1.

FIG. 4 shows a cross-sectional view of another nozzle 39 that may be used in the apparatus 20 of FIG. 1. The nozzle 39 of the illustrated example has a nozzle body 120 with a nozzle chamber 122 and a nozzle orifice 125, which has a length, $L_M$, that is, in some examples, preferably about 6 mm. The nozzle orifice 125, in some examples, advantageously has a hollow cylinder shape. The hollow cylinder shape of the illustrated example has a diameter, $D_M$, which preferably ranges from 0.5 mm and 3 mm and, in some examples, is advantageously approximately 1 mm. A portion 126, in the illustrated example, points in a general direction toward the nozzle orifice 125 and the nozzle chamber 122 has a cross section that is conically tapered toward the nozzle orifice 125. The opening angle, α, of the cone in the portion 126 with the conically tapered cross section is obtuse. Preferably, in some examples, the opening angle, α, is in a range from 105°≤α≤180°. In examples where an opening angle of the cone of the illustrated example is approximately 180° in the portion 126, the pulsating high-pressure fluid jet may be generated with fluid droplets, which have a form beneficial for the removal of material. In some examples, at a fluid pressure between 300 bar and 600 bar, the nozzle 39 is used to generate high-pressure fluid jet pulses with liquid droplets having a high kinetic energy for efficient material removal of, for example, metallic materials.

In some examples, the opening angle α is defined to be greater than 180°, in particular, up to 240° in certain examples. In this case, cavitation arises to an increased extent in the nozzle orifice, which in turn promotes droplet formation at the nozzle outlet to a particular degree.

Figure 5:
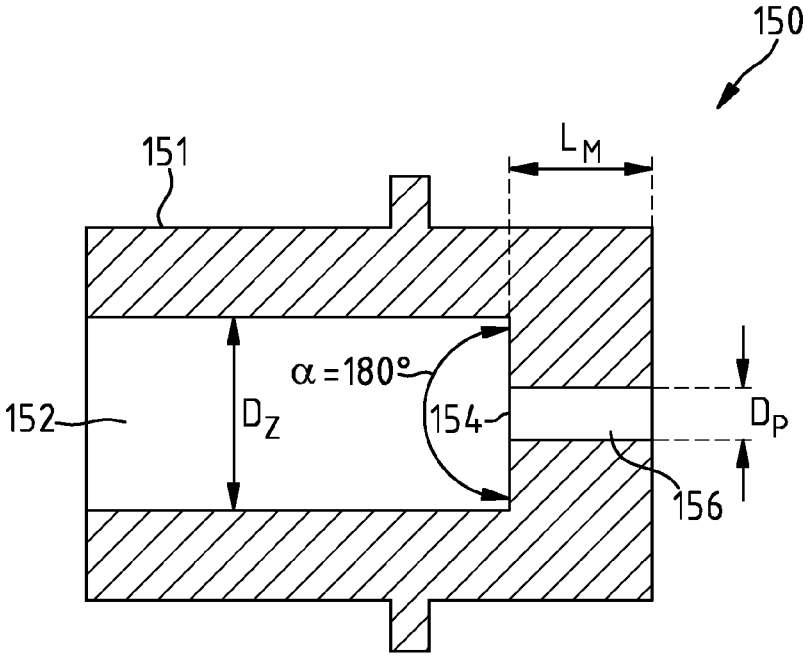
FIG. 5 shows a cross-sectional view of another example nozzle that may be used in the example apparatus of FIG. 1.

FIG. 5 shows a cross-sectional view of another example nozzle 150 that may be used in the example apparatus 20 of FIG. 1 having a nozzle body 151 with a nozzle chamber 152 in the general shaped similar to a circular cylinder. The nozzle chamber 152 of the illustrated example is axially aligned to the opening 154 of the nozzle orifice 156. The nozzle orifice 156 of the illustrated example is configured as a bore. The diameter, $D_P$, of the bore of the nozzle orifice 156 is approximately ⅓ of the diameter, $D_Z$, of the nozzle chamber. The nozzle orifice 156 of the illustrated example has a length, $L_M$, of approximately 6 mm. In some examples, at a fluid pressure on the order of magnitude of 60 bar, the nozzle 150 in the apparatus 20 may generate pulsating fluid jets of water to machine metallic materials with rapid material removal.

In some examples, fan-jet nozzles, star nozzles, squared nozzles, triangular nozzles or nozzles that generate a round jet are suitable for use in the apparatus 20.

One of the advantages of the examples described herein is that little or no minor cavitation forms in the nozzles during operation with high-pressure liquid, and, thus, the nozzles of the examples described exhibit relatively low wear with use.

Figure 6:
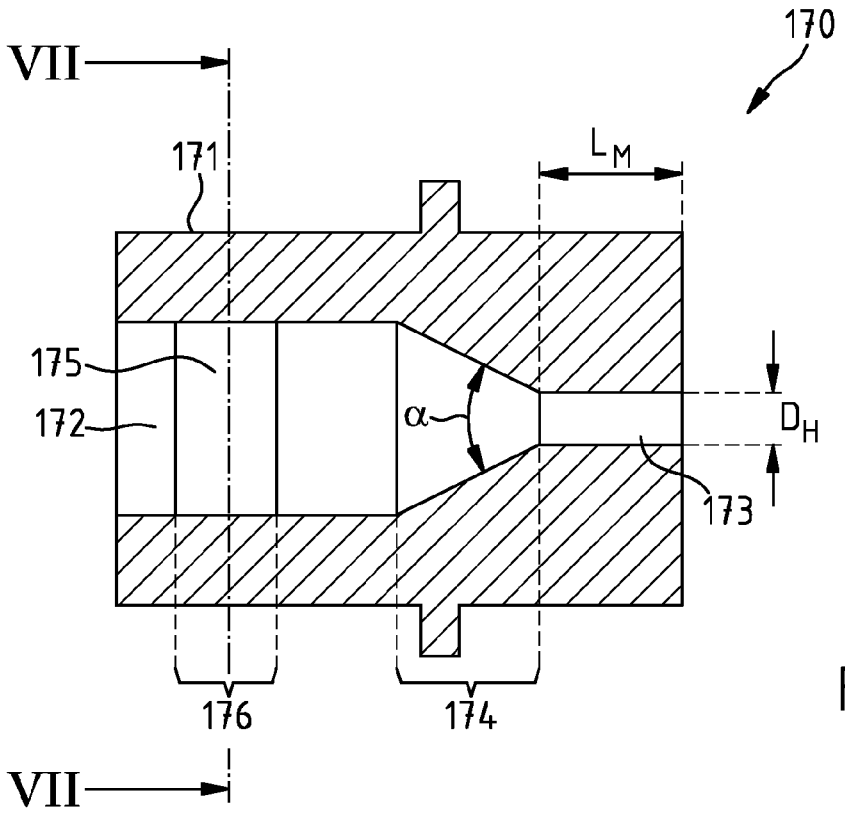
FIG. 6 shows a cross-sectional view of yet another example nozzle that may be used in the example apparatus of FIG. 1 with a jet director.

FIG. 6 shows a cross-sectional view of yet another example nozzle 170 that may be used in the apparatus 20 of FIG. 1 with a jet director. The nozzle 170 has a nozzle body 171 with a nozzle chamber 172 and a nozzle orifice 173. The nozzle orifice of the illustrated example has a length, $L_M$, of approximately 6 mm and a diameter, $D_H$, where $D_H$≈1 mm. In the portion 174 pointing toward the nozzle orifice 173, the nozzle chamber 172 has a cross section that is conically tapered toward the nozzle orifice 173. In the illustrated example, the opening angle, α, of the cone in the portion 173 with the conically tapered cross section is acute. In some examples, an advantageous value for the opening angle, α, is approximately 58°. The nozzle 170 of the illustrated example comprises a jet director 175 to prevent turbulence of the pressurized fluid in the nozzle chamber 172.

Figure 7:
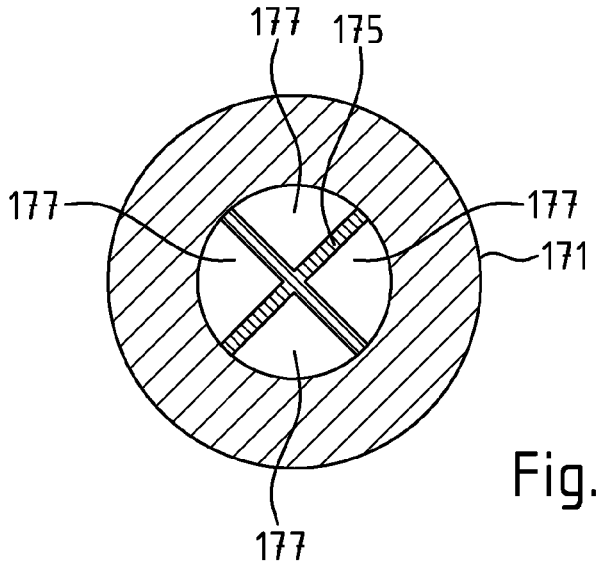
FIG. 7 shows a cross-sectional view of the example nozzle of FIG. 6 along the line VII-VII.

FIG. 7 shows a cross-sectional view of the example nozzle 170 of FIG. 6 along the line VII-VII. The jet director 175 divides the nozzle chamber 172 into four separate flow ducts 177 in the portion 176 shown in connection with FIG. 6.

The system 10 shown in connection with FIG. 1 has a device 130 to process fluid supplied into the chamber 22 by the pressure pump 91. The device 130 substantially removes dirt particles from the fluid circulated in the system 10. As a result, particles and coating parts detached from a workpiece 15 are flushed out of the workpiece 15 by flushing devices in the system 10 and are captured with the fluid in a dirt tank of the device 130. In some examples, the device 130 comprises a filter system to remove the particles and contaminants detached from the workpiece from the fluid supplied to the device 130 to prevent damage to the apparatus 20.

Figure 8:
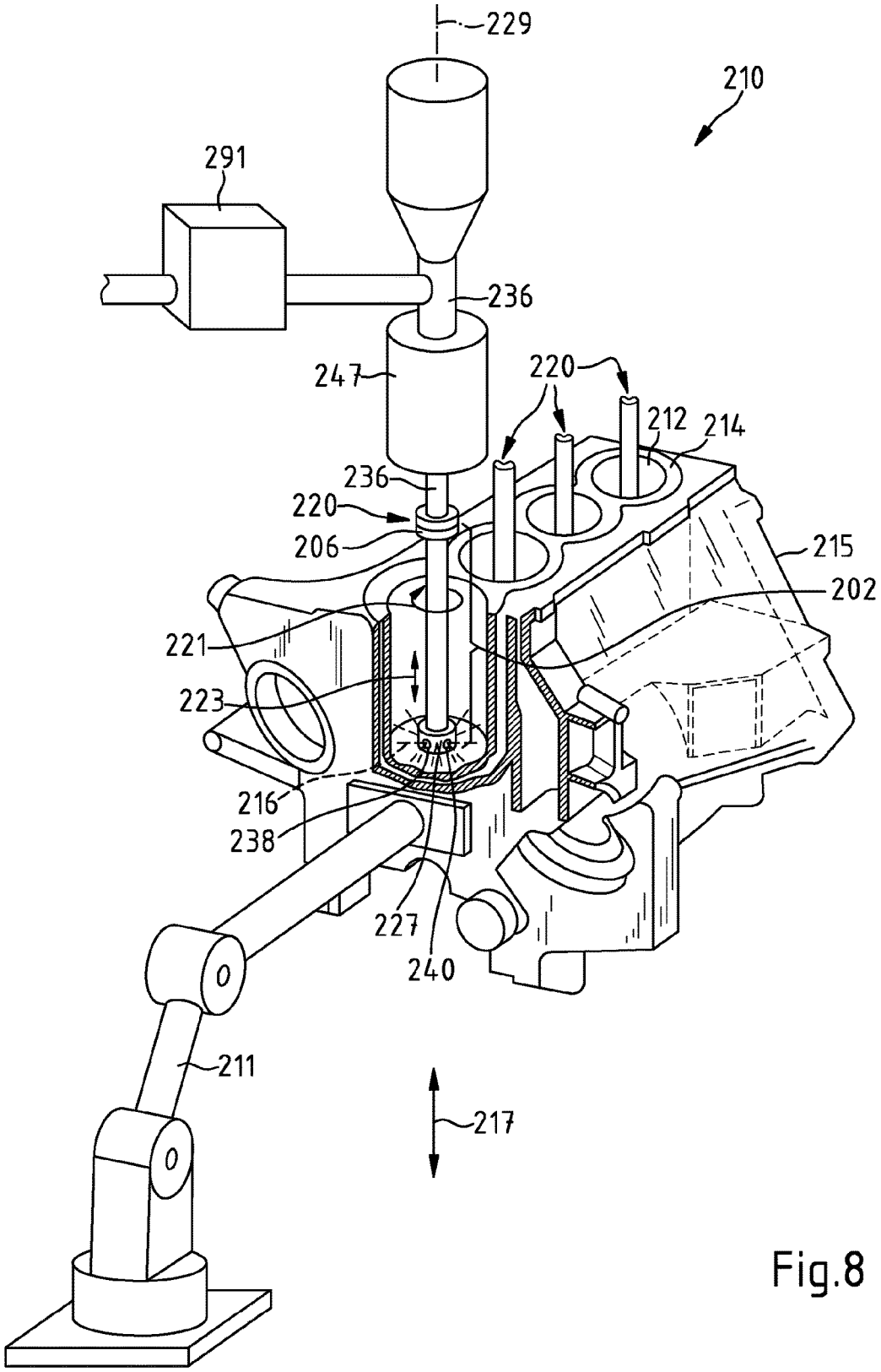
FIG. 8 shows another example system to generate a pulsating high-pressure fluid jet with nozzles positioned in a turret.

FIG. 8 shows another example system 210 to generate a pulsating high-pressure fluid jet with nozzles positioned in a turret. In the illustrated example, the system 210 activates the surface 212 of cylinder head bores 214 in a cylinder crank casing 215 by pulsating high-pressure water jets 216. The assemblies in the system 210 that correspond to assemblies in the system 10 described with reference to FIGS. 1 to 5 are designated in FIG. 8 by numerical references incremented by the number 200. In the system 210 of the illustrated example, there are a plurality of apparatus 220 positioned adjacent to one another to generate a pulsating high-pressure fluid jet.

In each of the apparatus 220 of the illustrated example, the line system 236 has a tool portion 202 with a tool head 204, in which a plurality of nozzles 238, 240 are located. The tool portion 202 is positioned in the line system 236 by an automatically operable coupling device 206. The coupling device 206 of the illustrated example allows automatic replacement of the tool portion 202 using a quick-acting replacement device, which has a turret magazine providing different tool heads to be used in the apparatus 220.

The nozzles 238, 240 may have, for example, any of the geometries described in connection with FIGS. 4-6 and 7. A tool portion 258 having the tool head 204 of the illustrated example may be rotated about the axis 229 by a drive. The nozzles 238, 240 of the illustrated example are subjected to water supplied to the apparatus 220 by a high-pressure pump 291. To set the effective path length of pressure waves generated in the chamber 222, the line system 236 of the apparatus 220 has an adjusting device 247.

In the illustrated example of FIG. 8, the system 210 has an industrial robot 211. The industrial robot 211 of the illustrated example is a multiple-axis system manipulator to move a workpiece, which in this example is the cylinder crank casing 215, relative to the apparatus 220. In some examples, the industrial robot 211 moves the apparatus 220 to generate pulsating high-pressure fluid jets relative to the workpiece.

The industrial robot 211 of the illustrated example is used to raise and lower the cylinder crank casing 215 with respect to the apparatus 220 in a general direction depicted by a double-headed arrow 217. In the illustrated example, using the pulsating high-pressure water jets 216 from the nozzles positioned in the turret 227 activates the surface of the material in the wall of the cylinder head bores 214 for arc plasma coating by introducing a bond structure onto the surface. In some examples, structures (e.g., helical threaded structures) may be produced to which a layer produced by flame spraying, plasma spraying and/or arc wire spraying in a cylinder head bore bonds particularly well in scenarios where the high-pressure water jet is subjected to a pulsating high-pressure fluid jet at a direction that is inclined at the angle β, where 0°≤β≤60° and, preferably, β≈45° with respect to the local surface normal of the wall. In this illustrated example, the tool head 204 is moved in a rotatable manner in the cylinder head bore 214 in a general direction depicted by an arrow 221 and is simultaneously displaced in a translating manner in the direction of the axis of the bore in a general direction depicted by a double-headed arrow 223. In the illustrated example, different degrees of roughness may be produced in a relatively simple manner at different or adjacent points of a workpiece using the examples described herein. For example, more or fewer smooth transitions may be produced between regions of varying roughness.

Figure 9:
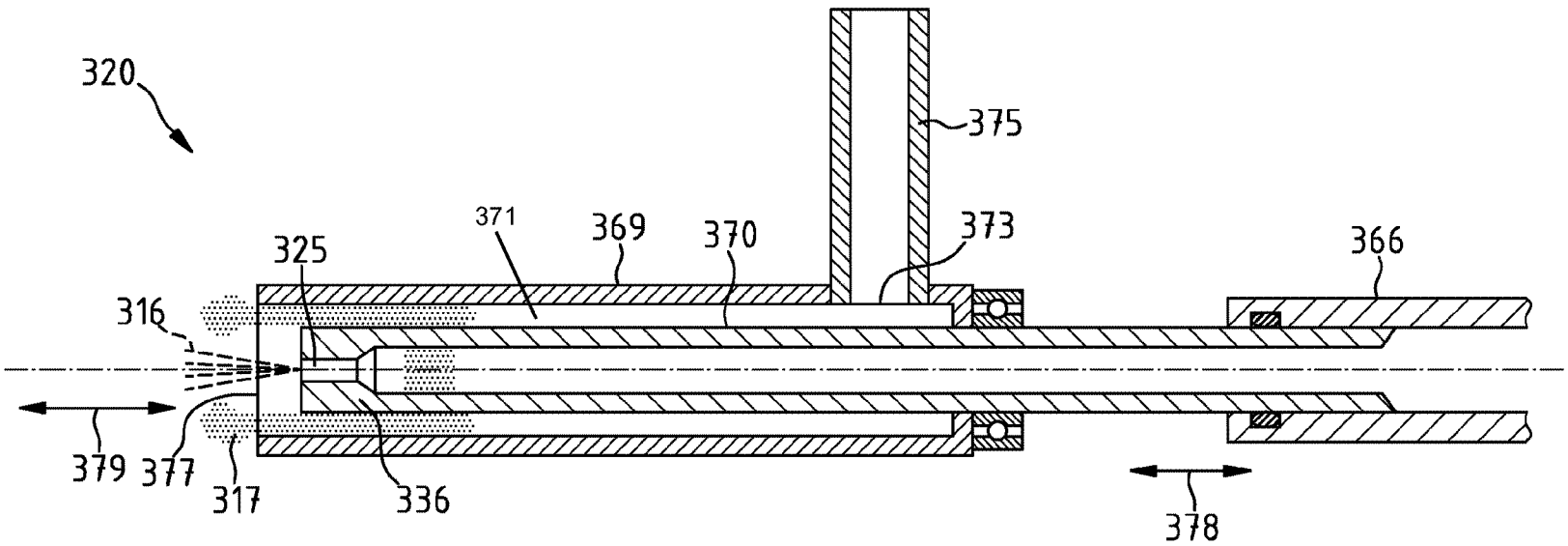
FIG. 9 shows a cross-sectional view of a portion of another example apparatus to generate a pulsating high-pressure fluid jet enveloped in a gas stream.

FIG. 9 shows a cross-sectional view of a portion of another example apparatus 320 to generate a pulsating high-pressure fluid jet 316 enveloped in a gas stream 317. The assemblies in the apparatus 320 correspond to assemblies in the apparatus 20 numerical references referenced in connection with FIG. 6 incremented by the number 300.

In the illustrated example, the envelopment of the pulsating high-pressure fluid jet 316 in the gas stream 317 allows machining of workpieces immersed in a liquid bath using the high-pressure fluid jet 316.

The apparatus 320 of the illustrated example has a nozzle 336 formed on a line section 370. The line section 370 is guided to allow the line section 370 to move linearly within the line section 366, in which the line section 370 displaces in a general direction depicted by a double-headed arrow 378 to allow the effective path length of pressure waves between a chamber for generating pressure waves and a side of the nozzle orifice 325, which faces away from the workpiece, to be set (e.g., adjusted, controlled, etc.).

The line section 370 is positioned in a nozzle 369 having a nozzle chamber 371 with an opening 373 to supply pressurized gaseous medium to the nozzle chamber 371 from a line 375. The nozzle chamber 371 of the illustrated example has an outlet opening 377 from which the gas stream 317 emerges. In the illustrated example, the nozzle chamber 369 and the line section 370 may be displaced relative to one another in a general direction depicted by a double-headed arrow 379. The displacement of the nozzle 369 relative to the nozzle 336 allows setting of the form of the fluid droplets in a pulsating high-pressure fluid jet 316 generated using the apparatus 320.

Figure 10:
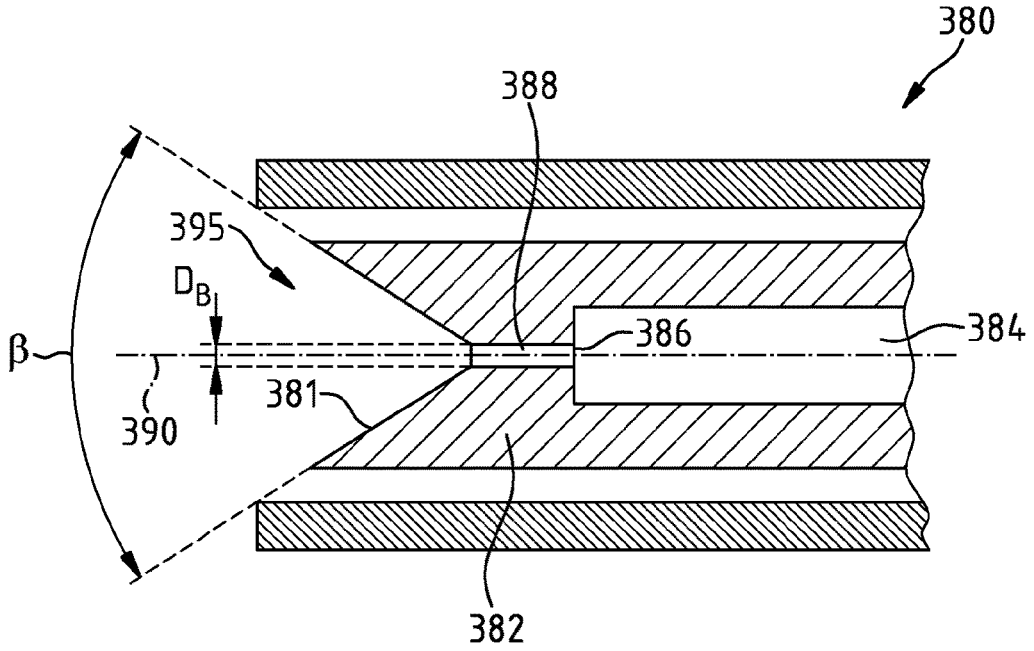
FIG. 10 shows a cross-sectional view of a portion of another example apparatus to generate a pulsating high-pressure fluid jet enveloped in a gas stream by a nozzle.

FIG. 10 shows a cross-sectional view of a portion of another example apparatus 380 to generate a pulsating high-pressure fluid jet 390 enveloped in a gas stream by a nozzle 382. The nozzle 382 of the illustrated example has a nozzle chamber 384 with an opening 386 axially aligned to the nozzle orifice 388. The nozzle orifice 388 of the illustrated example is configured as a bore. In this example, the diameter, $D_B$, of the bore of the nozzle orifice is approximately 1 mm. In the illustrated example, at the opening 386 of the end of the nozzle chamber 384, the nozzle orifice 388, preferably, has a rounded phase with a radius of curvature, r, where $r<0.1$ mm.

The portion 381 of the nozzle 382 directed (e.g., pointed) toward the workpiece, in this example, is shaped similarly to a cup or a funnel, which widens in the direction of a pulsating fluid jet 390 emerging from the nozzle orifice 388 and has the opening angle, β, where $\beta \approx 60°$.

In the illustrated example, the shape of the portion 381 of the nozzle 382 that points toward the workpiece such that if the nozzle is used in a liquid bath, a gas stream sweeping along an outer wall 393 of the nozzle 382 removes the liquid in the liquid bath from a region 395 upstream of the funnel-shaped portion to allow a pulsating high-pressure fluid jet to emerge relatively unhindered from the nozzle orifice 388 and impinge on a workpiece positioned within the vicinity of the nozzle 382.

Figure 11:
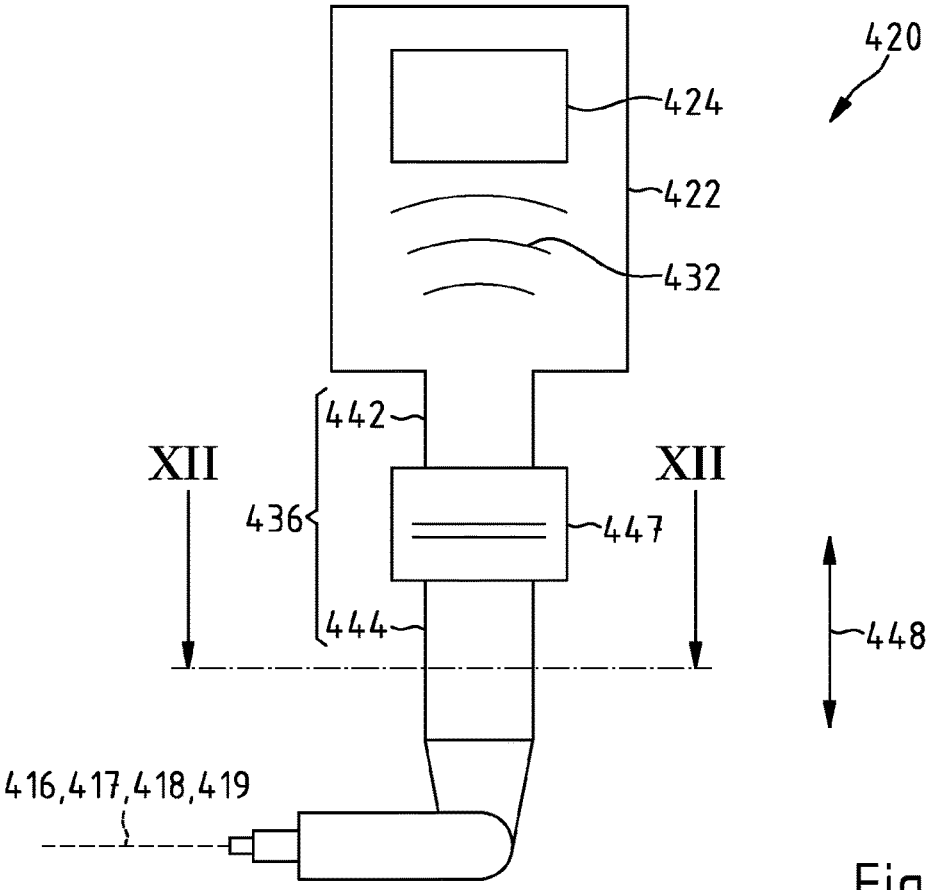
FIG. 11 shows another example apparatus to generate a pulsating high-pressure fluid jet using a nozzle rake.

FIG. 11 shows another example apparatus 420 to generate pulsating high-pressure fluid jets 416, 417, 418, 419 using a nozzle rake. The apparatus 420 of the illustrated example has a chamber 422 with a device 424 to generate fluid pressure waves 432. The apparatus 420 has a line system 436 having a chamber-side portion 442 and a nozzle-side portion 444. To set the path length for the fluid pressure waves 432 in the line system 436, the nozzle-side portion 444 of the illustrated example is displaced relative to the chamber-side portion 442 by an adjusting device 447, in a general direction depicted by a double-headed arrow 448.

Figure 12:
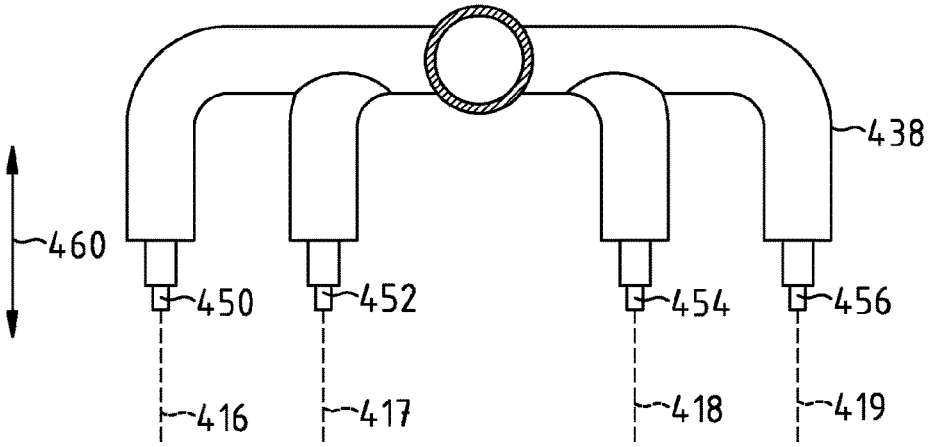
FIG. 12 shows a cross-sectional view of the example apparatus of FIG. 11 along the line XII-XII.

FIG. 12 shows a section through the apparatus 420 of FIG. 11 along the line XII-XII. In the illustrated example of FIG. 12, the nozzle-side portion 444 of the line system 436 has a line 438 that is branched in the general shape of a rake and has four nozzles that are integrated onto the line 438. Each of the nozzles of the illustrated example are integrated onto the line 438 have nozzle bodies 450, 452, 454, 456, respectively, each of which is displaceable and having a nozzle orifice displaceable in a general direction depicted by a double-headed arrow 460. The displacement of the nozzle bodies 450, 452, 454 and 456 allows the Helmholtz numbers, Hen, to be set where $Hen=Ln/\lambda$ (i.e., the quotient of the path lengths of the nozzle bodies 450, 452, 454, 456 for the fluid pressure waves in the line system 436 between the outlet opening in the chamber 422 and the respective nozzle orifice of the nozzle) and the wavelength, λ, of the fluid pressure waves 422 in the line system 436, where the amplitude, $A_P$, of a fluid pressure wave generated in the chamber 422 is at its approximate maximum upstream of each respective nozzle orifice in the nozzle bodies 450, 452, 454, 456.

The examples disclosed herein are suitable for machining surfaces of workpieces, activating surfaces of workpieces for coating, machining, removing coatings on workpieces, and/or cleaning workpieces.

The examples disclosed herein are suitable, for example, for activating a workpiece surface to allow the workpiece to be coated by flame spraying, plasma spraying, and/or arc wire spraying. Specifically, it has been determined that microstructures with undercuts may be produced in the surface of workpieces by a pulsating high-pressure fluid jet. In some examples, thermal coatings applied to such a surface effectively bond to the surface due to molten particles readily penetrating microstructures during coating due to the kinetic energy and/or capillary action and then later solidify. In some examples, a coating applied to a workpiece surface activated by the examples disclosed herein may have a relatively high tensile bonding strength, which, in some examples, may be 30 MPa or more.

To ensure that the coating applied to a workpiece effectively bonds to the surface, in some examples, it is advantageous when the surface of a workpiece to be coated is dried after activation in the examples disclosed herein, for example, by pouring out liquid, air drying, and/or vacuum drying.

It has been determined specifically that a particularly effective bond may be achieved for a layer applied to the surface of a workpiece by flame spraying, plasma spraying, and/or arc wire spraying when the surface of the workpiece is first subjected to a pulsating high-pressure fluid jet generated by the examples disclosed herein to roughen the surface and when the roughened surface of the workpiece is subsequently rolled with a defined contact pressure. In particular, it has been established that the mesoscopic elevations of a roughened surface may be deformed and compressed by the rolling process to form microstructures with undercuts that have a high mechanical stability and into which molten particles may readily penetrate during the coating process.

The examples disclosed herein are also suitable for machining workpiece coatings (e.g., removing overspray on workpieces that have been subjected to a coating process). Setting the work angle of the pulsating high-pressure fluid jet, the outlet velocity thereof from a nozzle orifice and/or the frequency of the pressure waves (e.g., the repetition rate for the high-pressure fluid jet), so that the edges, for example, of coating portions on a workpiece may be machined in a defined manner. The examples disclosed herein allow edges that form a 45° angle with the workpiece surface to be produced.

It has been determined that a pulsating high-pressure fluid jet may be used to introduce a bevel edge onto the coating of workpieces, (e.g., a coating produced by means of arc wire spraying ("AWS") on the cylinder head surfaces of internal combustion engines) without risking, as in the example of machining with cutting tools, coating detachment from the workpiece during machining by the pulsating high-pressure fluid jets.

The examples disclosed herein are suitable, for example, for machining a workpiece surface produced by flame spraying, plasma spraying, arc wire spraying, deburring a workpiece, removing dirt from a workpiece, and/or removing layers on a workpiece. The examples disclosed herein are also suitable for roughening workpiece surfaces, in order to prepare the workpieces for integral joining (adhesive bonding, welding, soldering).

The examples disclosed herein may be operated, in some examples, with alkaline washing fluid, water and/or emulsion (e.g., water-oil emulsion and/or oil). In order to avoid corrosion of the apparatuses and systems, in some examples, it is advantageous to mix anticorrosives with the fluid used to machine workpieces.

The examples disclosed herein may be used to finish portions of workpieces in general, workpieces consisting at least partially of aluminum or magnesium, in which the surface coating is iron-containing material applied by means of laser wire welding, and workpieces consisting at least partially of steel or gray cast iron and/or workpieces where the surface coating is nickel-containing material applied by laser wire welding.

The examples disclosed herein may also be used to compact the surface of workpieces by subjecting the workpiece to a pulsating fluid jet. It has been determined that, by treating cylinder crank casings made of die-cast aluminum, the cavities that disrupt coating in the region of the cylinder running faces may be closed off (e.g., isolated) by a pulsating high-pressure fluid jet of water.

In some examples, the following features of the examples disclosed herein are used to generate the pulsating fluid jets 16, 18 of pressurized fluid. The apparatus 20 comprises the line system 36, which has the at least one nozzle 38, 40 with the nozzle orifice 125 from which a pulsating fluid jet of pressurized fluid may emerge. The apparatus 20 also has the chamber 22, in which the pressure wave generating device 24 for generating fluid pressure waves 32 is positioned. The chamber 22 communicates with the line system 36 via the outlet opening 34 for the generated fluid pressure waves 32. The apparatus 20 also comprises the setting devices 31, 47, 62, 64 for controlling the amplitude, $A_P$, of the fluid pressure waves 32 in the line system 36 upstream of the at least one nozzle orifice 125. The setting device 31, 47, 62, 64 may be used to set a Helmholtz number, He, where $He=L/\lambda$ (e.g., the quotient of the path length, L, of the fluid pressure waves 32 in the line system 36 between the outlet opening 34 in the chamber 22 and the at least one nozzle orifice 125 of the at least one nozzle 38, 40 and the wavelength, $\lambda$, of the fluid pressure waves 32 in the line system 36).

The examples disclosed herein operate by, for example, coupling oscillation energy in the form of pressure waves onto a fluid jet, which is subjected to an elevated pressure at values of 20 bar or greater, to generate fluid pulses, in which oscillation energy is converted into kinetic energy. In the examples disclosed herein, the kinetic energy that may be transferred to the fluid by generating pressure waves, may be maximized by ensuring that the reflections of pressure waves in a line system for supplying pressurized fluid to a nozzle do not significantly reduce (e.g., eliminate) the generated pressure waves (e.g., destructively interfere), but rather reinforce (e.g., constructively interfere). The examples disclosed herein allow adjustment of the ratio of the effective path length, of which the pressure waves travel in the line system from the outlet opening in the chamber to a nozzle orifice of a nozzle, to the wavelength of the fluid pressure waves (e.g., a Helmholtz number to characterize the fluid pressure waves in the line system).

For this ratio adjustment (e.g., Helmholtz number adjustment), the line system, in some examples, comprises a first line section and a second line section, which is at least partially accommodated in the first line section. The second line section communicates therewith and may be displaced relative to the first line section in the longitudinal direction. It is advantageous, in some examples, if the second line section is guided in a linearly movable manner relative to the first line section (e.g., with a thread). In some examples, it may be advantageous for a fixing device to be provided, with which the second line section may be fixed to the first line section.

Additionally or alternatively, to set the Helmholtz number, the apparatus may also comprise frequency setting means, which make it possible to set the frequency of the generated fluid pressure waves. By varying the frequency of the fluid pressure waves, for example, the wavelength of the fluid may also be altered.

The examples described herein allow workpiece surfaces to be roughened and/or cleaned without abrasive additives.

The line system, in some examples, may advantageously have a first line system portion with a connection to a pressure pump and a second line system portion with a receptacle for the nozzle. In other examples, it may be advantageous if the first portion and the second portion are coupled by a rotary joint. In such examples, the second line system portion may be moved in the rotary joint relative to the first line system portion in an oscillating and/or rotating manner about an axis coaxial to the axis of a fluid duct formed in the second portion, thereby allowing formation of regular or irregular structures on the surface of a workpiece bore. Some examples may preferably comprise a motor drive to move the second line system portion in relation to the first line system portion.

In some examples, the line system advantageously has a first line system portion with a connection to a pressure pump and has a second line system portion, in which a plurality of nozzles are positioned. In such examples, each nozzle has a nozzle orifice. In some examples, each nozzle orifice may be supplied with fluid by separate line branches. In some examples, a line of adjustable length for pressurized fluid is positioned in each of the separate line branches to the nozzles. This adjustment of the line, in some examples, allows adjustment of the path length of fluid pressure waves generated in the chamber between the nozzle orifice and the outlet opening corresponding to the fluid pressure waves in the chamber.

In some examples, the effective cross section of the lines in the line system decreases, preferably monotonically, between the outlet opening for fluid pressure waves in the chamber and the nozzle orifice of the nozzle, the amplitude of the pressure waves increases toward the nozzle orifice in the direction of flow of the fluid. In some examples, to remove air bubbles in the chamber, a vent valve may be advantageous. Such a vent valve may be preferably positioned to allow the air bubbles to escape, even if the apparatus is displaced. In some examples, the vent valve is positioned (e.g., located within) in a top cover portion of the chamber.

In some examples, the chamber has an opening separate from the outlet opening to supply high-pressure fluid, thereby allowing the outlet opening to efficiently supply fluid into the chamber. In order to ensure that the energy supplied to the pressure wave generating device is converted in an efficient manner to pressure waves, in some examples, it is advantageous for the pressure wave generating device is located in a dead water region of the chamber.

In some examples, in order to strengthen the pressure waves within the fluid, the chamber has a cross section tapered similar to a funnel shape along the direction of the outlet opening. In some examples, it is advantageous to provide a sensor for sensing pressure waves in the chamber to monitor the pressure wave generation. In some examples, the sensor is a pressure sensor positioned in a tapered portion of the chamber that is shaped substantially similar to a funnel shape along the direction of the outlet opening.

In some examples, the at least one nozzle has a nozzle chamber with a cross section tapering toward the nozzle orifice. Extensive experimental tests have demonstrated that fluid pulses with a substantially high kinetic energy may be generated by the nozzle if the nozzle chamber has, for example, a conically tapered portion with an obtuse opening angle, $\alpha$, preferably in a range of $105° \leq \alpha \leq 180°$ upstream of the nozzle orifice. In some examples, the at least one nozzle has a cylindrical, preferably circular-cylindrical, nozzle chamber with an opening positioned at an end adjacent the nozzle orifice. The fluid pulses generated using such a nozzle are particularly readily suitable for material removal in examples with aluminum materials. In regards to cavitation, in some examples, a nozzle of this type allows the formation of fluid droplets, which are particularly suitable for the removal of material and present in the pulsating fluid jet.

In example devices for generating a gas stream that envelops a pulsating fluid jet at least in portions, workpieces immersed within liquid may be machined by the pulsating fluid jet. In these examples, the gas stream that surrounds the high-pressure fluid jet ensures that the liquid into which the workpiece is immersed does not decelerate the fluid jet. The liquid surrounding the workpiece in these examples advantageously dampens noise. Extensive experimental tests have shown that a particularly effective cleaning action may be achieved for the workpiece if the at least one nozzle has a cup-shaped portion pointing towards the workpiece, in which the pulsating fluid jet emerges from the nozzle orifice and the opening cross-section of which widens in the direction towards the workpiece. In some examples, to clean the largest possible workpiece surface possible, it is advantageous if the at least one nozzle is a nozzle rake having a plurality of nozzle orifices.

In some examples, it is advantageous to utilize a system having an apparatus to generate a fluid jet with a receiving device for workpieces, in which the workpieces are subjected to a pulsating fluid jet. The system, in some examples, has a fluid collecting device to collect fluid released by the apparatus, where the apparatus is coupled to a pressure pump in order to return the collected fluid into the apparatus. In such examples, since the system comprises a measuring device for sensing material, which has been removed from a workpiece by a fluid jet, the material removal caused by the pulsating fluid jet may be monitored.

In order to modify the physical properties of components for specific applications such as, for example, increasing the mechanical and thermal load-bearing capacity of internal combustion engines, the components are finished with high-value coatings at certain locations of the combustion engines. Such coatings generally require the surface of these assemblies to be prepared (e.g., roughened and/or activated) for the coating. To prepare the surface, in some examples, the workpieces are corundum blasted and/or sand blasted. Additionally or alternatively, the surface of such workpieces may be subjected to cutting machining by cutting tools in preparation for an application of coating.

In some examples, structures may be produced onto the surface of a workpiece by a pulsating fluid jet to improve the bond of a coating on the surface to allow the coating to withstand substantially high shearing forces. Specifically, it has been found that, in some examples, the tribological properties of aluminum assemblies may be significantly improved by the coating of aluminum materials using thermal spraying processes (e.g., flame spraying, plasma spraying, atmospheric plasma spraying and/or arc wire spraying, etc.). Arc wire spraying allows, for example, coating of aluminum assemblies with an iron-based alloy with a carbon content between 0.8 and 0.9% by weight and comprising dispersing, friction-reducing fillers in the form of graphite, molybdenum disulfide and/or tungsten disulfide.

The coating of materials also allows reduction of the weight of produced engine components, and/or more compact designs of the engine components (e.g., a cylinder crank casing, in which the cylinder bores are at a reduced distance to one another in comparison with conventional spacing of typical casings).

In some examples, it is advantageous to use one or more apparatus in accordance with the teachings of this disclosure to generate a fluid jet directed towards workpieces. In some examples, such apparatus may include a controllable device for setting the pressure of fluid supplied to the line system (e.g., pressure-setting device). Some examples may also include a computer unit communicatively coupled to the pressure-setting device and the pressure wave generating device. Such a computer unit may also have a data storage device to store a parameter map for the application-specific setting of the fluid pressure, the amplitude and/or the frequency of the fluid pressure waves that are generated by the pressure wave generating device. In some examples, the parameter map also stores a favorable nozzle rotational speed depending on factors including material to be machined (e.g., a substrate), a given workpiece geometry, a workpiece surface quality (e.g., a workpiece surface roughness), a type of workpiece contamination and/or a machining distance between a workpiece to be machined and the at least one nozzle orifice of the apparatus. Moreover, in some examples, the parameter map stores an advantageous angle of a pulsating high-pressure fluid jet generated by a corresponding apparatus relative to a workpiece surface.

In some examples, systems having a controlling device may preferably have a manipulator to move a workpiece to be subjected to fluid relative to the apparatus or move the apparatus relative to the workpiece. Such a manipulator, in some examples, may perform entirely free movements (e.g., linear movements, free curved movements). In particular, in some examples, the manipulator is an articulated arm robot with six axes of movement.

In one example, a surface of a workpiece is activated for flame spraying, plasma spraying, arc wire spraying, and/or to prepare it for adhesive bonding by use of a pulsating fluid jet which may be generated by, for example, the examples disclosed herein. Additionally or alternatively, in some examples, a workpiece surface produced by flame spraying, plasma spraying, or arc wire spraying may be machined using a pulsating fluid jet generated by the examples disclosed herein.

Preparation of a wall of a bore in a workpiece to produce, for example, the bonding properties of a workpiece surface caused by arc wire spraying may be optimized when the nozzle is subjected to a pulsating high-pressure fluid jet generated in a direction inclined at an angle, $\beta$, where $0° \leq \beta \leq 60°$ and, preferably, $\beta \approx 45°$ with respect to the local surface normal of the wall, and/or the nozzle is moved in a rotating manner about the axis of the bore and displaced in a translating manner in the direction of the axis of the bore relative to the workpiece. The distance between the nozzle opening and the workpiece surface is, in this example, preferably between 10 mm and 150 mm.

It has been determined that a portion of a workpiece may be finished where, in a first step, a surface coating is applied to the workpiece, and where, in a second step, the coating is then machined and/or partially removed by a pulsating fluid jet. Such a fluid jet may be generated by the examples disclosed herein. It has also been found that the surface of a workpiece may be activated by a pulsating fluid jet, which is, for example, generated by the examples disclosed herein to increase the bonding properties of the coating on the surface, the mechanical and/or thermal load-bearing capacity of the coating. It has been determined that a surface of a workpiece consisting at least partially of aluminum or aluminum alloy, and/or magnesium alloy may be activated by a pulsating fluid jet generated by, for example, the examples disclosed herein to apply a surface coating made of iron-containing material to the workpiece by thermal spraying processes (e.g., arc wire spraying, AWS, plasma spraying, etc.), and then to machine the surface coating with a pulsating fluid jet generated by the examples disclosed herein. In some examples, the surface of a workpiece consisting at least partially of steel or gray cast iron may be activated by a pulsating fluid jet generated by, for example, the examples disclosed herein to apply a surface coating including nickel-containing material to said workpiece by laser wire welding. Moreover, a coating applied to a workpiece consisting of steel, gray cast iron, aluminum, aluminum alloy, and/or a magnesium alloy in the form of iron-containing or nickel-containing material applied by means of laser wire welding may be machined by a pulsating fluid jet generated by the examples disclosed herein.

In some examples, a surface coating over a large area may be applied first and then, subsequently, the surface coating may be removed in small area(s) of edge regions.

As set forth herein, one example apparatus for generating a pulsating pressurized fluid jet includes a line system having at least one nozzle with at least one nozzle orifice from which a pulsating fluid jet of pressurized fluid emerges, and a chamber having a pressure wave generating device to generate fluid pressure waves, where the chamber is in fluid communication with the line system through an outlet opening for the generated fluid pressure waves. The example apparatus also includes a setting device for controlling the amplitude of the fluid pressure waves in the line system upstream of the at least one nozzle orifice where the setting device sets a quotient of a path length of the fluid pressure waves between the outlet opening and the at least one nozzle orifice, and the wavelength of the fluid pressure waves in the line system.

In some examples, the setting device has at least one line of adjustable length positioned in the line system to adjust the path length of the generated fluid pressure waves between the at least one nozzle orifice and the outlet opening. In some examples, the setting device has at least one line of adjustable length positioned in the line system to adjust the path length of the generated fluid pressure waves between the at least one nozzle orifice and the outlet opening. In some examples, the adjustable line has a first line section and a second line section at least partially positioned in the first line section where the second line section is in fluid communication with the first line section and displaces relative to the first line section in the longitudinal direction thereof. In some examples, the setting device sets the frequency of the fluid pressure waves generated by the pressure wave generating device.

In some examples, the line system has a first line system portion with an opening to supply fluid from a high-pressure pump and has a second line system portion with the at least one nozzle, where the first line system portion and the second line system portion are coupled by a rotary joint. In some examples, the second line system portion moves in the rotary joint relative to the first line system portion in an oscillating or a rotating manner about an axis coaxial with an axis of a fluid duct positioned in the second portion. In some examples, the line system has a first line system portion with an opening to supply liquid to a high-pressure pump and has a second line system portion with a plurality of nozzles that may be supplied with fluid through separate line branches. In some examples, a line of adjustable length for pressurized fluid is positioned in each of the separate line branches to the nozzles, and adjusts the path length of fluid pressure waves generated in the chamber between a nozzle orifice of the nozzle, where the nozzle orifice is supplied with fluid via the line branch and the outlet opening for fluid pressure waves in the chamber.

In some examples, the effective cross section of the lines in the line system decreases between the outlet opening for fluid pressure waves in the chamber and the nozzle orifice. In some examples, the chamber has an opening spaced apart from the outlet opening to supply high-pressure fluid, where the fluid supplied to the nozzle is guided through the chamber. In some examples, the pressure wave generating device is positioned in a dead water region of the chamber. In some examples, the chamber has a portion with a cross section that tapers in a funnel-like shape toward the outlet opening. In some examples, the at least one nozzle has a nozzle chamber with a portion having a cross section that tapers in a funnel-like shape toward the nozzle orifice.

In some examples, the portion of the nozzle chamber is conically tapered at an obtuse opening angle ranging from 105° to 180°. In some examples, the portion of the nozzle chamber is conically tapered at an acute opening angle, where a jet director for avoiding or reducing turbulence is positioned in the nozzle chamber. In some examples, the at least one nozzle has a cylindrical nozzle chamber with an opening positioned at an end adjacent the nozzle orifice. Some examples also include a device to generate a gas stream to envelop the pulsating fluid jet in at least a portion of the pulsating fluid jet.

One example system for generating a pulsating jet of pressurized fluid includes a pulsating fluid jet generating apparatus to generate a pulsating fluid jet having a chamber with a wave generating device to generate fluid pressure waves and a setting device to control the amplitude of the fluid pressure waves, where the setting device sets a quotient of a path length of the fluid pressure waves and the wavelength of the fluid pressure waves. The example system also includes a receiving device for workpieces, in which the workpieces are subjected to the pulsating fluid jet, and a fluid collecting device to collect fluid released by the pulsating fluid jet generating apparatus that is coupled to a pressure pump to return the collected fluid into the apparatus.

In some examples, the system also includes a controllable device to set the pressure of fluid supplied to the line system, and a computer unit communicatively coupled to the controllable device and the pressure wave generating device. In some other examples, the example system also includes a data storage device to store a parameter map of the application-specific setting of one or more of the fluid pressure, the amplitude, the frequency of the fluid pressure waves generated by the pressure wave generating device, a nozzle rotational speed depending on one or more of a material to be machined, a workpiece geometry, a workpiece surface quality, a type of workpiece contamination, or a machining distance between a workpiece to be machined and the at least one nozzle orifice.

In some examples, the system is used for activating a workpiece surface to allow the workpiece surface to be coated by one or more of flame spraying, plasma spraying, or arc wire spraying. In some examples, the system is used for machining a workpiece surface produced by one or more of flame spraying, plasma spraying, or arc wire spraying. In some examples, the system is used for one or more of deburring a workpiece, removing dirt from a workpiece, removing layers on a workpiece, subjecting a workpiece surface to fluid, or compacting a workpiece surface.

An example apparatus for machining a wall of a bore in a workpiece includes a line system having at least one nozzle with at least one nozzle orifice from which a pulsating fluid jet of pressurized fluid emerges and a chamber having a pressure wave generating device to generate fluid pressure waves, where the chamber is in fluid communication with the line system through an outlet opening for the generated fluid pressure waves. The example apparatus also includes a setting device for controlling the amplitude of the fluid pressure waves in the line system upstream of the at least one nozzle orifice, where the setting device sets a quotient of a path length of the fluid pressure waves between the outlet opening and the at least one nozzle orifice, and a wavelength of the fluid pressure waves in the line system. The wall of the bore of the example apparatus is subjected to the pulsating high-pressure fluid jet from a nozzle inclined at an angle in the range from 0° to 60° with respect to the local surface normal of the wall. The nozzle of the example apparatus is moved in one or more of a rotatory manner about the axis of the bore, or in a translating manner displaced in the direction of the axis of the bore relative to the workpiece An example apparatus for finishing a portion of a workpiece includes a line system having at least one nozzle with at least one nozzle orifice from which a pulsating fluid jet of pressurized fluid emerges, and a chamber having a pressure wave generating device to generate fluid pressure waves, where the chamber is in fluid communication with the line system through an outlet opening for the generated fluid pressure waves. The example apparatus also includes a setting device for controlling the amplitude of the fluid pressure waves in the line system upstream of the at least one nozzle orifice, where the setting device sets a quotient of a path length of the fluid pressure waves between the outlet opening and the at least one nozzle orifice, and a wavelength of the fluid pressure waves in the line system. A surface coating is applied to the portion of the workpiece. The surface coating is then machined by the pulsating high-pressure fluid jet generated.

In some examples, the portion of the workpiece is activated before the surface coating is applied by the pulsating high-pressure fluid jet.

One example process for machining a wall of a bore in a workpiece includes subjecting the wall of the bore to a pulsating high-pressure fluid jet from a nozzle inclined at an angle in the range from 0° to 60° with respect to the local surface normal of the wall. The example process also includes moving the nozzle in one or more of a rotatory manner about the axis of the bore, or in a translating manner displaced in the direction of the axis of the bore relative to the workpiece, where the pulsating high-pressure fluid jet is generated using the examples disclosed herein.

Another example process for finishing a portion of a workpiece includes applying a surface coating to the portion of the workpiece, and machining the surface coating by a pulsating high-pressure fluid jet generated using the examples disclosed herein.

It is noted that this patent arises from a continuation-in-part of International Patent Application No. PCT/EP2012/060208, which was filed on May 31, 2012, which claims priority to German Patent Application No. 10 2011 080 852, which was filed on Aug. 11, 2011. The foregoing International Patent Application and German Patent Application are hereby incorporated herein by reference in their entireties.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus for generating a pulsating fluid jet of pressurized fluid comprising:

a line system comprising at least one nozzle having at least one nozzle orifice from which a pulsating fluid jet of pressurized fluid is to emerge from, the line system defining a path length from an outlet opening to the at least one nozzle orifice, the line system including a first line section and a second line section that is movably coupled with the first line section, the second line section at least partially accommodated in the first line section;

a chamber upstream of the line system and having a pressure wave generating device to generate fluid pressure waves in fluid within the chamber, wherein the chamber is in fluid communication with the line system through the outlet opening from which the generated fluid pressure waves are to emerge from into the line system, the generated pressure waves having a pressure wave amplitude and travelling the path length, the line system characterized by a Helmholtz number that is defined as a ratio of the path length and a wavelength of the fluid pressure waves; and a setting device including means for adjusting the path length, the means for adjusting the path length to vary the Helmoltz number by displacing the second line section relative to the first line section along a longitudinal direction thereof to define an oscillation antinode of the generated fluid pressure waves at the at least one nozzle orifice.

2. The apparatus as defined in claim 1, wherein the line system has a first line system portion with an opening to supply fluid from a high-pressure pump and has a second line system portion with the at least one nozzle, wherein the first line system portion and the second line system portion are coupled by a rotary joint.

3. The apparatus as defined in claim 2, wherein the second line system portion moves in the rotary joint relative to the first line system portion in an oscillating or a rotating manner about a rotational axis of the rotary joint that is coaxial to an axis of a fluid duct positioned in the second portion.

4. The apparatus as defined in claim 1, wherein the line system has a first line system portion with an opening to supply liquid to a high-pressure pump and has a second line system portion with a plurality of nozzles of the at least one nozzle orifice to be supplied with fluid through separate line branches.

5. The apparatus as defined in claim 4, wherein a line of adjustable length for pressurized fluid is positioned in each of the separate line branches to the plurality of nozzles, and adjust the path length, wherein the nozzle orifice is supplied with fluid via the line branch and the outlet opening for fluid pressure waves in the chamber.

6. The apparatus as defined in claim 1, wherein an effective cross section of lines in the line system decreases between the outlet opening for fluid pressure waves in the chamber and the at least one nozzle orifice.

7. The apparatus as defined in claim 1, wherein the chamber has an opening spaced apart from the outlet opening to supply high-pressure fluid, wherein the fluid supplied to the at least one nozzle orifice is guided through the chamber.

8. The apparatus as defined in claim 1, wherein the pressure wave generating device is positioned in the chamber.

9. The apparatus as defined in claim 1, wherein the chamber has a portion with a cross section that tapers in a funnel-like shape toward the outlet opening.

10. The apparatus as defined in claim 1, wherein the at least one nozzle has a nozzle chamber with a portion having a cross section that tapers in a funnel-like shape toward the nozzle orifice.

11. The apparatus as defined in claim 10, wherein the portion of the nozzle chamber is conically tapered at an obtuse opening angle ranging from 105° to 180°.

12. The apparatus as defined in claim 10, wherein the portion of the nozzle chamber is conically tapered at an acute opening angle, and wherein a jet director for avoiding or reducing turbulence is positioned in the nozzle chamber.

13. The apparatus as defined in claim 1, wherein the at least one nozzle has a cylindrical nozzle chamber with an opening positioned at an end adjacent the nozzle orifice.

14. The apparatus as defined in claim 1, further comprising a device to generate a gas stream to envelop the pulsating fluid jet in at least a portion of the pulsating fluid jet.

15. The apparatus as defined in claim 1, wherein a surface coating is applied to the portion of the workpiece, and wherein the surface coating is machined by the pulsating high-pressure fluid jet generated.

16. The apparatus as defined in claim 15, wherein the portion of the workpiece is activated by the pulsating high-pressure fluid jet before the surface coating is applied.

17. The apparatus as defined in claim 1, wherein the pressure wave amplitude of the generated fluid pressure waves is adjusted by the setting device based on at least one of a geometry or work piece quality of a work piece that is downstream of the at least one nozzle orifice.

18. An apparatus for generating a pulsating fluid jet of pressurized fluid comprising:

a line system comprising at least one nozzle having at least one nozzle orifice from which a pulsating fluid jet of pressurized fluid is to emerge from, the line system defining a path length from an outlet opening to the at least one nozzle orifice, the line system including a first line section and a second line section that is movably coupled with the first line section, the second line section at least partially accommodated in the first line section;

a chamber upstream of the line system and having a pressure wave generating device to generate fluid pressure waves in fluid within the chamber, wherein the chamber is in fluid communication with the line system through the outlet opening from which the generated fluid pressure waves are to emerge from into the line system, the generated pressure waves having a pressure wave amplitude and travelling the path length, the line system characterized by a Helmholtz number that is defined as a ratio of the path length and a wavelength of the fluid pressure waves; and a setting device including a motor to adjust the path length by displacing the second line section relative to the first line section to adjust the path length to vary the Helmoltz number to define an oscillation antinode of the generated fluid pressure waves at the at least one nozzle orifice.

19. An apparatus for generating a pulsating fluid jet of pressurized fluid comprising:

a line system comprising at least one nozzle having at least one nozzle orifice from which a pulsating fluid jet of pressurized fluid is to emerge from, the line system defining a path length from an outlet opening to the at least one nozzle orifice;

a chamber upstream of the line system and having a pressure wave generating device to generate fluid pressure waves in fluid within the chamber, wherein the chamber is in fluid communication with the line system through the outlet opening from which the generated fluid pressure waves are to emerge from into the line system, the generated pressure waves having a pressure wave amplitude and travelling the path length, the line system characterized by a Helmholtz number that is defined as a ratio of the path length and a wavelength of the generated pressure waves; and a setting device including means for adjusting the path length, the means for adjusting the path length to vary the Helmoltz number by displacing the second line section relative to the first line section along a longitudinal direction thereof to define an oscillation antinode of the generated fluid pressure waves at the at least one nozzle orifice.

* * * * *